US005561351A

United States Patent [19]

Vrionis et al.

[11] Patent Number: 5,561,351

[45] Date of Patent: Oct. 1, 1996

[54] DIMMER FOR ELECTRODELESS DISCHARGE LAMP

[75] Inventors: Nickolas G. Vrionis, Los Altos; Roger Siao, Mountain View; Donald E. Pezzolo, Los Altos Hills; James W. Pfeiffer, Los Gatos; Derek Bray, Los Altos; Larry A. Lincoln, Milpitas, all of Calif.

[73] Assignee: Diablo Research Corporation, Sunnyvale, Calif.

[21] Appl. No.: 329,696

[22] Filed: Oct. 26, 1994

Related U.S. Application Data

[63] Continuation of Ser. No. 188,628, Jan. 28, 1994, abandoned, which is a continuation of Ser. No. 961,763, Oct. 14, 1992, abandoned.

[51] Int. Cl.[6] ..... H05B 41/16

[52] U.S. Cl. ..... 315/248; 315/291; 315/307; 315/111.21; 315/DIG. 4

[58] Field of Search ..... 315/248, 307, 315/194, DIG. 4, DIG. 7, 267, 282, 111.21, 291

[56] References Cited

U.S. PATENT DOCUMENTS

| | | | |
|---|---|---|---|
| 4,383,203 | 5/1983 | Stanley | 315/248 |
| 4,733,138 | 3/1988 | Pearlman et al. | 315/307 |
| 4,864,194 | 9/1989 | Kobayashi et al. | 315/248 |
| 4,955,018 | 9/1990 | Twitty et al. | 370/85.1 |
| 4,969,147 | 11/1990 | Markkula, Jr. et al. | 370/94.1 |
| 5,090,024 | 2/1992 | Van Mey et al. | 375/1 |
| 5,101,142 | 3/1992 | Chatfield | 315/308 |
| 5,105,127 | 4/1992 | Lavaud et al. | 315/291 |

*Primary Examiner*—Robert Pascal
*Assistant Examiner*—Haissa Philogene
*Attorney, Agent, or Firm*—Skjerven, Morrill, MacPherson, Franklin & Friel; David E. Steuber

[57] ABSTRACT

An arrangement for adjusting the intensity of an electrodeless discharge lamp is described. In one embodiment the high-frequency signal delivered to the induction coil is interrupted during a predetermined portion of a full duty cycle. This function is provided by a dimmer control unit which may be in an analog or digital form and may respond to a control signal provided by a potentiometer, a three-way lighting fixture or an addressable, remote controlled interface with data transmitted over the power lines or over a radio or infrared communication channel. In another embodiment the dimmer control unit alters the amplitude of the high-frequency signal supplied to the lamp's induction coil.

20 Claims, 18 Drawing Sheets

DIMMER FOR ELECTRODELESS DISCHARGE LAMP

This application is a continuation of patent application Ser. No. 08/788,628 filed Jan. 28, 1994, abandoned, which is a continuation of patent application Ser. No. 07/961,763, filed Oct. 14, 1992, abandoned.

FIELD OF THE INVENTION

This invention relates to electrodeless discharge lamps and, in particular, to methods and arrangements for varying the intensity of an electrodeless discharge lamp.

BACKGROUND OF THE INVENTION

Electrodeless discharge lamps operate by transmitting a high-frequency electromagnetic signal into a transparent sealed vessel containing a gaseous mixture, typically a mixture of mercury vapor and an inert gas. The electromagnetic energy creates a plasma of circulating charged particles, which excites the mercury atoms to higher energy states. When the mercury atoms fall back to their normal energy state, they give off light radiation, mostly in the non-visible, ultraviolet portion of the spectrum. The ultraviolet radiation impinges on phosphors that are coated on the surface of the vessel, and these phosphors in turn emit visible light.

The electromagnetic signal is generated by an induction coil, which is driven by a high-frequency amplifier whose output is preferably fed through a filter and matching network. Circuitry for driving the induction coil is described in commonly-owned patent application Ser. No. 07/887,168 now U.S. Pat. No. 5,306,986 and patent application Ser. No. 07/955,528, now abandoned, both of which are incorporated herein by reference.

Electrodeless discharge lamps are highly efficient, providing an output of approximately 60 lumens/watt, as compared with approximately 15 lumens/watt for a normal incandescent light bulb. These lamps therefore offer the prospect of substantial energy savings. These energy savings will be further enhanced if users of the lamps are able to adjust the intensity of the light output of the lamps to meet their needs. Arrangements according to the broad principles of this invention allow this to be done.

SUMMARY OF THE INVENTION

In accordance with this invention, a dimming control circuit varies the intensity of an electrodeless discharge lamp. This is accomplished either by repeatedly interrupting the output of the amplifier which drives the induction coil, or by reducing the supply voltage, so that the induction coil receives only a predetermined percentage of the energy that it would receive if it were operated normally.

The interruption function is provided by a dimming control circuit. The dimming control circuit may take numerous forms, and an analog and a digital embodiment are described.

In an illustrative analog embodiment, the 60 Hz supply voltage is used to generate a sawtooth waveform which is directed to an input of a comparator. The other input of the comparator is connected to a DC control voltage that is representative of the desired intensity of the lamp. The DC signal is generally at a level which is below the peak voltage of the sawtooth signal. When the sawtooth signal exceeds the DC signal, the output of the comparator is at a logic high; when the sawtooth signal is below the DC signal, the output of the comparator is at a logic low. By adjusting the level of the DC signal, one can vary the percentage of the time that the output of the comparator is high. The output of the comparator is used to adjust the percentage of the time that the amplifier provides a driving signal to the induction coil (i.e., the "duty cycle").

In an illustrative digital embodiment, two counters are used—a period counter and a duty cycle counter. Both counters receive the same clock pulse. The period counter is timed to count through a complete cycle during each full period. Each time the period counter carries, a binary number representative of the duty cycle is entered into the duty cycle counter. The two counters then count together until the duty cycle counter carries. The carrying of the period and duty cycle counters controls the flow of power to the induction coil. The binary number that is entered into the duty cycle counter during each period is determined by digital or analog means.

The analog or digital information used to control the intensity of the lamp can be generated in a wide variety of ways. It may be provided by an ordinary potentiometer, allowing the user to adjust the intensity of the lamp over a continuous range. For lamps designed to be used with three-way lighting fixtures, the control voltage may be provided at an output of a logic circuit which senses the position of the three-way switch. For lamps to be controlled remotely (by, for example, infrared signals, radio frequency signals, or signals delivered through the power lines) the control voltage may be provided by circuitry which recognizes an "address" of the lamp and generates a desired control value in response to commands received from a remote location. The control may be provided by a photodetector positioned to detect the light level in the vicinity of the lamp.

In accordance with another aspect of the invention, a voltage control device (e.g., a potentiometer or a triac) regulates the amplitude of the voltage output by the lamp's power supply. This in turn varies the amplitude of the signal received by the induction coil and the amount of power delivered to the plasma.

DESCRIPTION OF THE INVENTION

Figure 1:
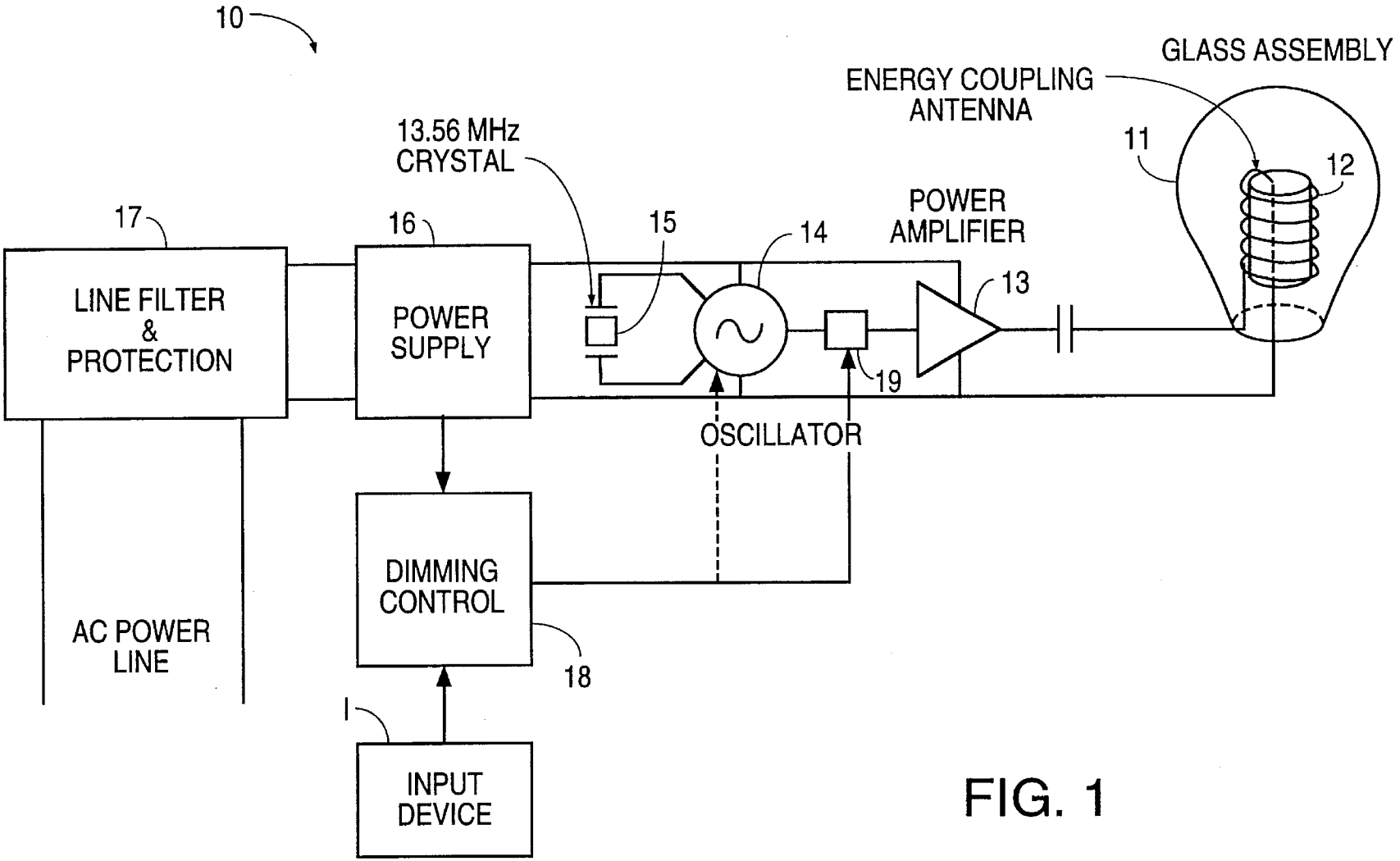
FIG. 1 illustrates a general block diagram of a electrodeless discharge lamp containing a dimming control unit in accordance with the invention.

FIG. 1 illustrates a general block diagram of a electrodeless discharge lamp 10 which includes a sealed vessel 11 and an induction coil 12. Sealed vessel 11 is coated with phosphors and filled with a mixture of mercury vapor and an inert gas such as argon. Induction coil 12 is driven by an amplifier 13 which receives a high-frequency signal (in this case, at 13.56 MHz) from an oscillator 14. The output of oscillator 14 is regulated by a 13.56 MHz crystal 15. Amplifier 13 and oscillator 14 are supplied by a power supply 16 which is connected through a line filter and protection unit 17 to the 60 Hz AC power lines. Amplifier 13 is preferably of the kind disclosed in commonly-owned patent application Ser. No. 07/887,168, now U.S. Pat. No. 5,306,986 or patent application Ser. No. 07/955,528, now abandoned, both of which are incorporated herein by reference. A filter and impedance matching network, preferably of the kind disclosed in commonly-owned patent application Ser. No. 07/887,166, now abandoned incorporated herein by reference, is connected between the output of amplifier 13 and induction coil 12, but this element has been omitted from FIG. 1 for the sake of clarity. Together amplifier 13, oscillator 14, crystal 15, power supply 16, line filter and protection unit 17 and the filter and impedance matching network (not shown) constitute a driving circuit for induction coil 12.

A dimming control unit 18 is controlled by an input control device/interface I. As described below, dimming control unit 18 and input control device/interface I both represent a wide variety of analog and digital devices and interfaces. An output of dimming control 18 leads to an analog gate 19 which is connected between the output of oscillator 14 and the input of amplifier 13. Dimming control unit 18 provides an output signal which controls analog gate 19 and thereby regulates the duty cycle of the energizing signal received by induction coil 12. Input control device/interface I provides dimming control unit 18 with the information it needs (in analog or digital form) to establish the desired value of the duty cycle (normally expressed as a percentage).

Figure 2:
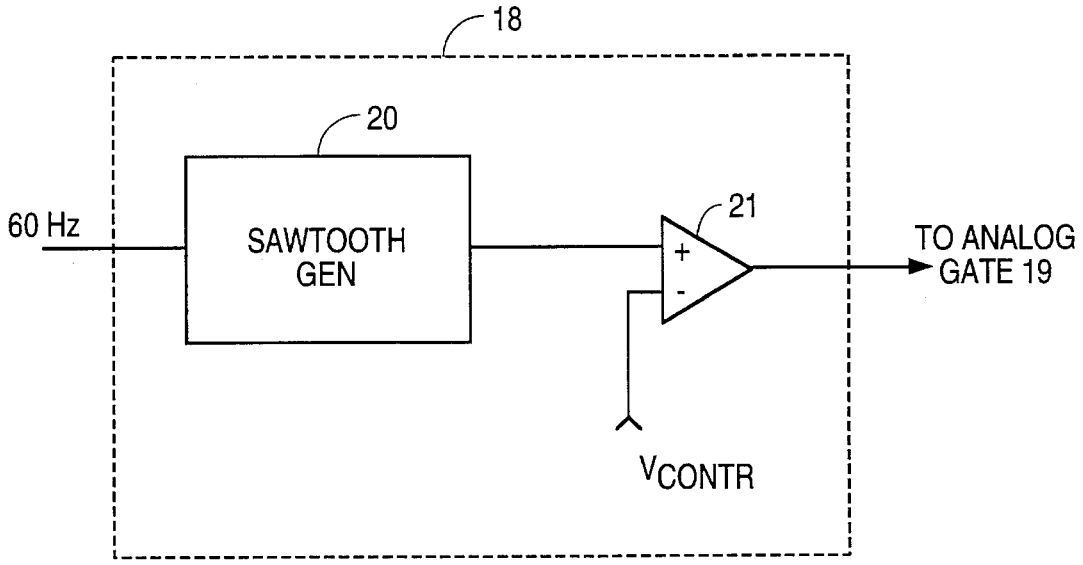
FIG. 2 illustrates a block diagram of an analog embodiment of the dimming control unit.

FIG. 2 illustrates an analog dimming control unit 18., including a sawtooth waveform generator 20 and a comparator 21. Sawtooth waveform generator 20 is connected to the 60 Hz power line and delivers a sawtooth waveform to the positive input of comparator 21.

Figure 3:
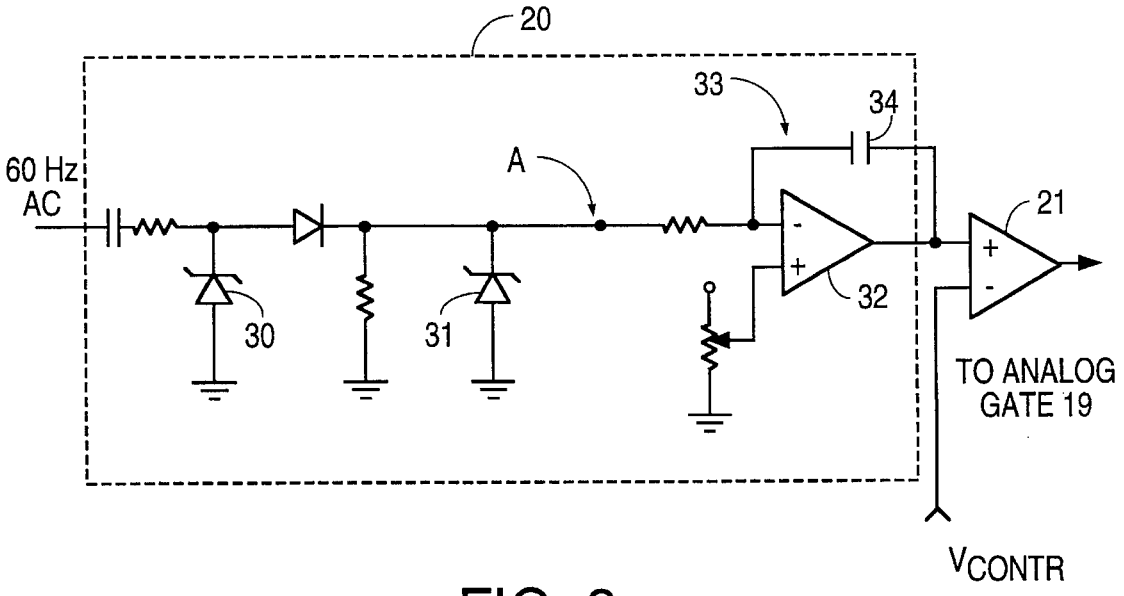
FIG. 3 illustrates a view of the sawtooth waveform generator included in the analog embodiment.
Figure 4A:
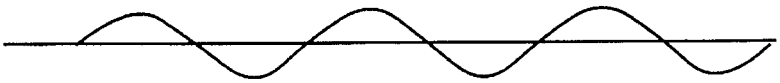
FIGS. 4A–4D illustrate waveforms which appear at various locations in the analog embodiment of the dimming control unit.
Figure 4B:
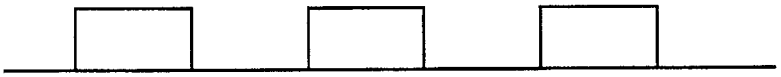

FIG. 3 illustrates sawtooth waveform generator 20 in more detail. The 60 Hz AC signal, illustrated in FIG. 4A, is directed to the input of this circuit, and a diode 30 clamps the point designated A to ground when the AC signal goes low. A zener diode 31 clamps point A at a positive level substantially below the peak of the AC signal. The voltage at point A varies as shown in FIG. 4B.

Figure 4C:
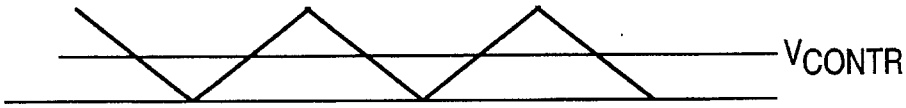

A differential amplifier 32 forms part of an integrator 33, which also includes a capacitor 34 linking the output and negative input of amplifier 32. The waveform at point A is directed to the negative input of amplifier 32. The output of sawtooth waveform generator 20 is illustrated in FIG. 4C. This sawtooth waveform is directed to the positive input of comparator 21.

Figure 4D:
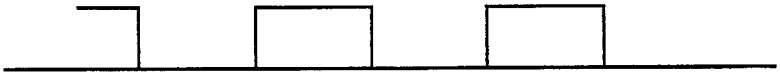

The negative input of comparator 21 is connected to a DC control voltage $V_{CONTR}$, which is maintained at a level between 0 V and the peak voltage of the sawtooth waveform illustrated in FIG. 4C. Since the output of comparator 21 is at a logic high when the voltage at the positive input is greater than the voltage at the negative input, comparator 21 delivers a logic high when the sawtooth waveform directed to the positive input exceeds the voltage $V_{CONTR}$ at the negative input. As illustrated in FIG. 4D, the result is a series of pulses having a uniform height and a width which depends on the level of $V_{CONTR}$. By varying the level of $V_{CONTR}$, the width of the pulses can be varied to any amount between 0 (when $V_{CONTR}$ equals the peak voltage of the sawtooth waveform) to the point where the pulses merge (when $V_{CONTR}$=0 V).

Figure 5:
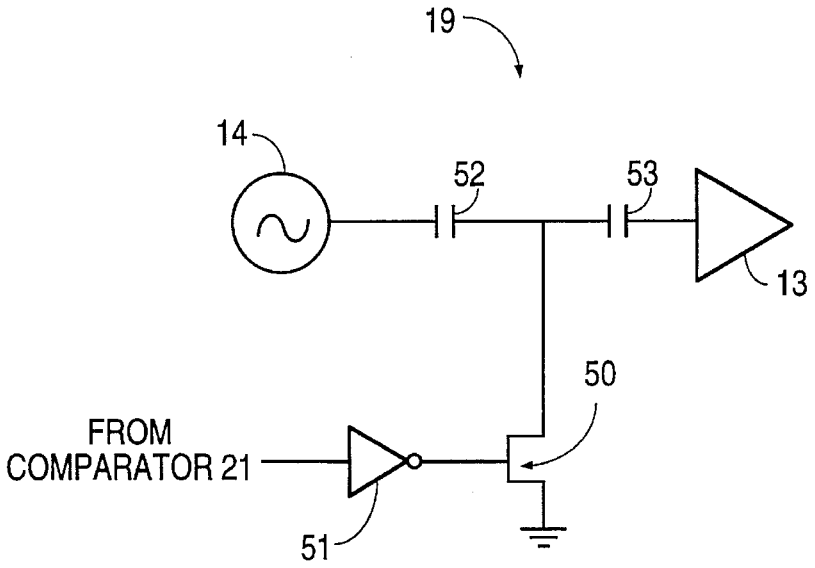
FIG. 5 illustrates a circuit diagram of an analog gate used to interrupt the signal flow from the oscillator to the power amplifier.

A possible configuration of analog gate 19 is illustrated in FIG. 5. The gate of a MOSFET 50 is connected to the output of comparator 21 through an invertor 51. Capacitors 52 and 53 are also connected between oscillator 14 and amplifier 13. Gate 19 is open when the output of comparator 21 is high, turning MOSFET 50 off, and closed when the output of comparator 21 is low. Thus, controlling $V_{CONTR}$ controls the percentage of the time during which gate circuit 19 is open and closed. Since amplifier 13 is not operative when it does not receive a signal from oscillator 14, induction coil 12 is not supplied with an energizing voltage when gate circuit 19 is closed. It will be understood that there are numerous alternative ways of interrupting or disabling the signal received by induction coil 12, such as by disabling amplifier 13 or oscillator 14 or any other component within the driving circuit which energizes induction coil 12. Numerous ways of achieving this will be evident to those skilled in the art and all of such ways are within the scope of this invention.

In this embodiment, the pulses (FIG. 4D) which open and close analog gate 19 are delivered at 60 Hz. This frequency is well below the level necessary to allow resonating voltages in the filtering and impedance matching circuit (not shown) to dissipate, so as to turn induction coil 12 off between the pulses. Moreover, the pulses are wide enough to allow electrodeless discharge lamp 10 to reach the magnetic or "H" mode each time induction coil 12 is turned on. The lamp must pass through an electric or "E" mode each time it is turned on before it reaches the H mode, which is the steady state mode of operation and is more efficient than the E mode. The transition through the E mode and subsequent formation of the H mode normally occurs within 0.5 milliseconds.

Figure 6:
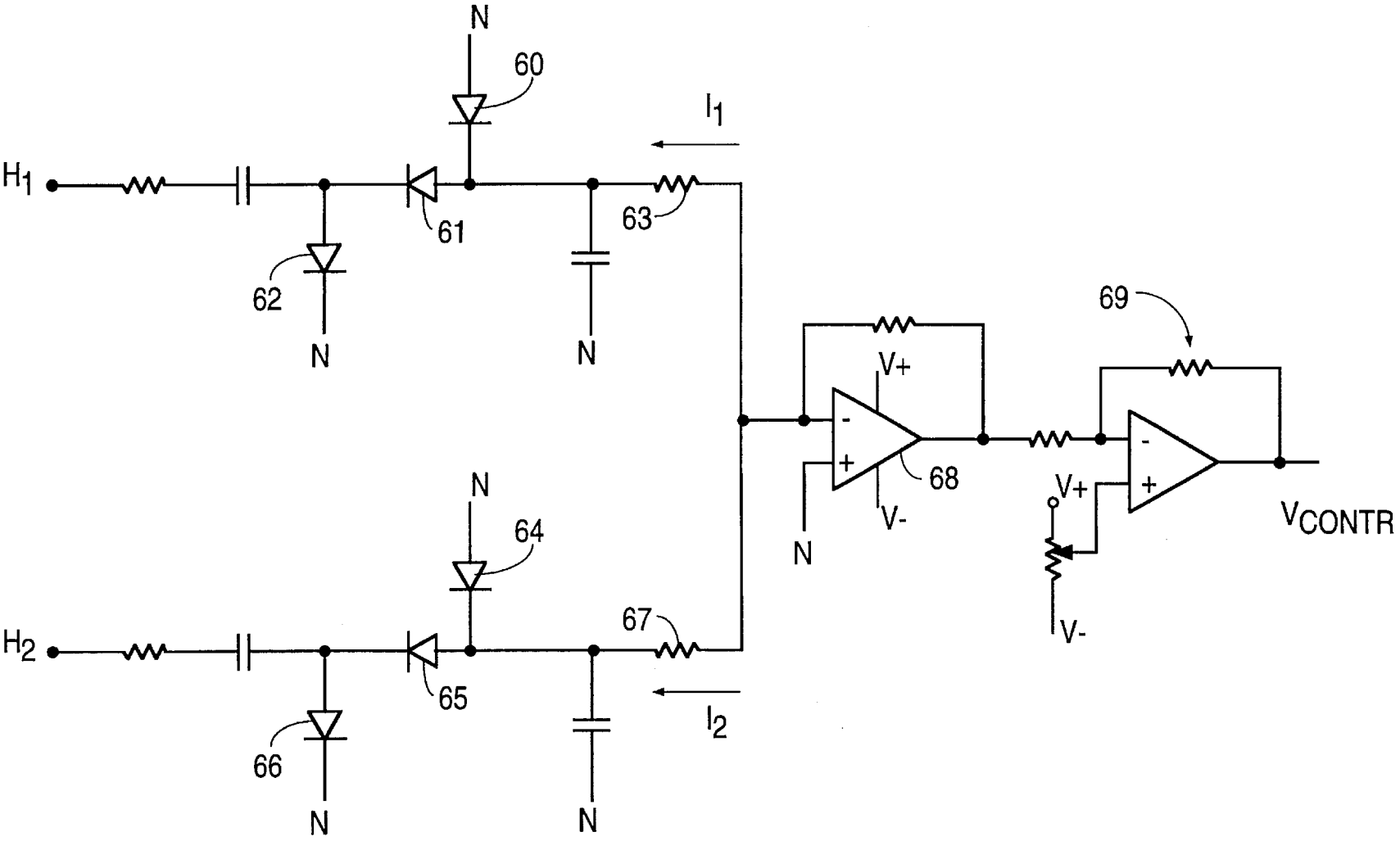
FIG. 6 illustrates a diagram of an input control device designed for use with a three-way lighting fixture.

Lamp 10 may be associated with an input device I which makes it compatible with conventional three-way lighting fixtures. An input device $I_a$ for this purpose is illustrated in FIG. 6. The two "hot" leads of a three-way switch are represented by lines $H_1$and $H_2$. Lines $H_1$ and $H_2$ are connected to the hot leads of the switch through the contacts of a conventional three-way socket. N represents the neutral third line. The three "on" positions of the switch are characterized by the presence of the 60 Hz line voltage on either $H_1$ or $H_2$ alone, or on both $H_1$ or $H_2$. When a 60 Hz signal appears on $H_1$, for example, diode 62 acts as a clamp during positive half-cycles, and a current $I_1$ flows through resistor 63. A similar current 12 flows through resistor 67 when a 60 Hz signal appears on $H_2$. If resistor 67 is twice as large as resistor 63, the voltage at the output of comparator 68 will be in a ratio 0:1:2:3, depending on whether a 60 Hz signal appears on neither $H_1$ nor $H_2$, $H_1$ only, $H_2$ only, or both $H_1$ and $H_2$. The output of comparator 68 is passed through an inverter 69 to yield $V_{CONTR}$.

The circuit shown in FIG. 6 thus delivers an analog voltage output representative of the state of its inputs. This is the control voltage $V_{CONTR}$ which is fed to the negative input of comparator 21. If, for example, the sawtooth waveform at the positive input of comparator 21 has a peak voltage of 5 V, the circuit of FIG. 6 might be set to deliver voltages of 0 V, 1.7 V and 3.3 V. When the 60 Hz AC signal appears on lines $H_1$ and $H_2$, the circuit of FIG. 6 would deliver a 0 V output, causing the output of comparator 21 to remain high and causing analog gate 19 to remain open. This represents the full power condition of lamp 10.

Figure 8:
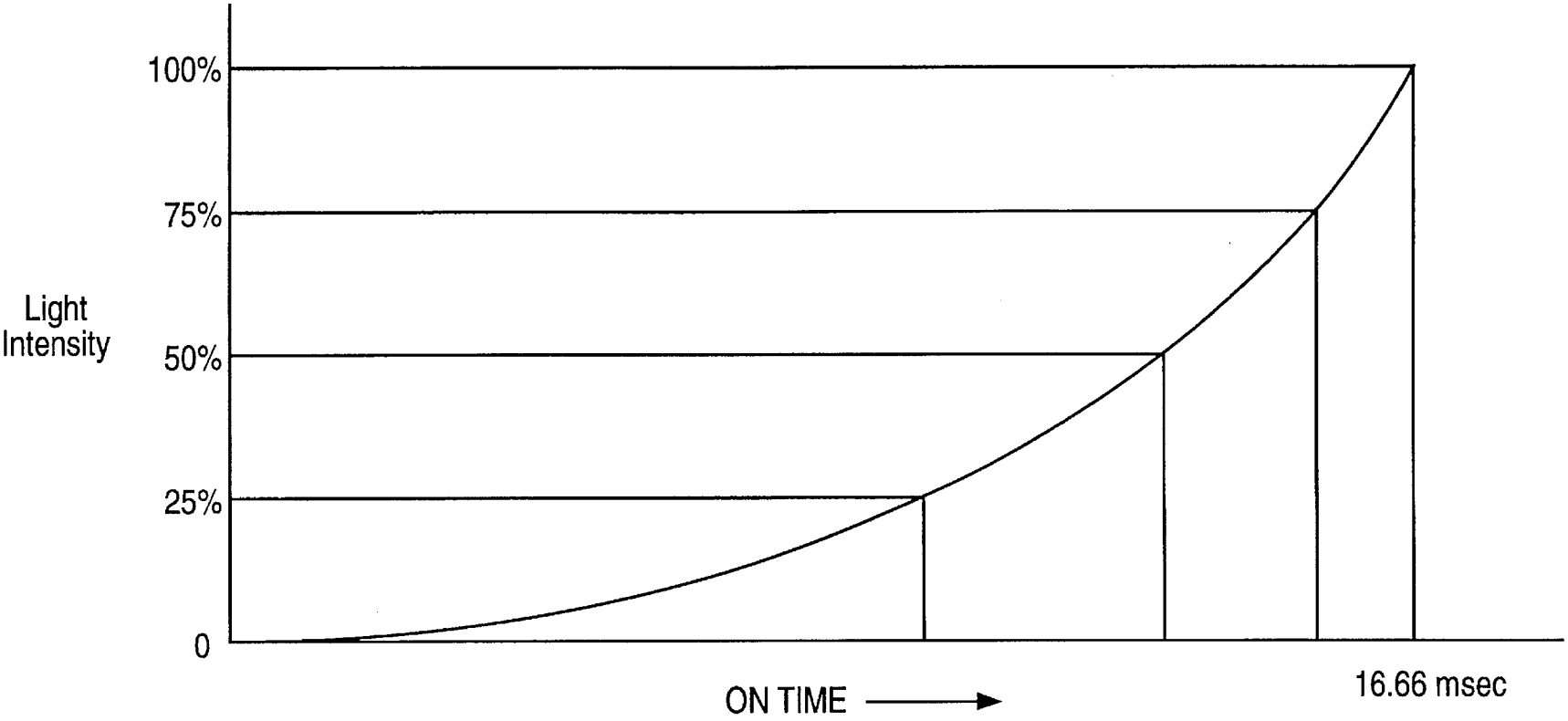
FIG. 8 is an illustrative graph of the intensity of an electrodeless discharge lamp as a function of the on-time or duty cycle.

It should be noted that the intensity of lamp 10 is not necessarily a linear function of duty cycle. FIG. 8 illustrates a possible graph of the intensity of lamp 10 as a function of on-time, based on a total period of 16.66 milliseconds, which corresponds to the 60 Hz frequency of sawtooth waveform generator 20 (duty cycle (%)=(on-time total period) ×100). As FIG. 8 indicates, an on-time of approximately 8 milliseconds (duty cycle =50%) is required to obtain a 25% level of intensity. A curve similar to FIG. 8 should be generated to determine the on-time required to achieve a desired intensity level. The duty cycles should be set so as to yield intensities that the eye will perceive as consistently spaced.

Figure 9:
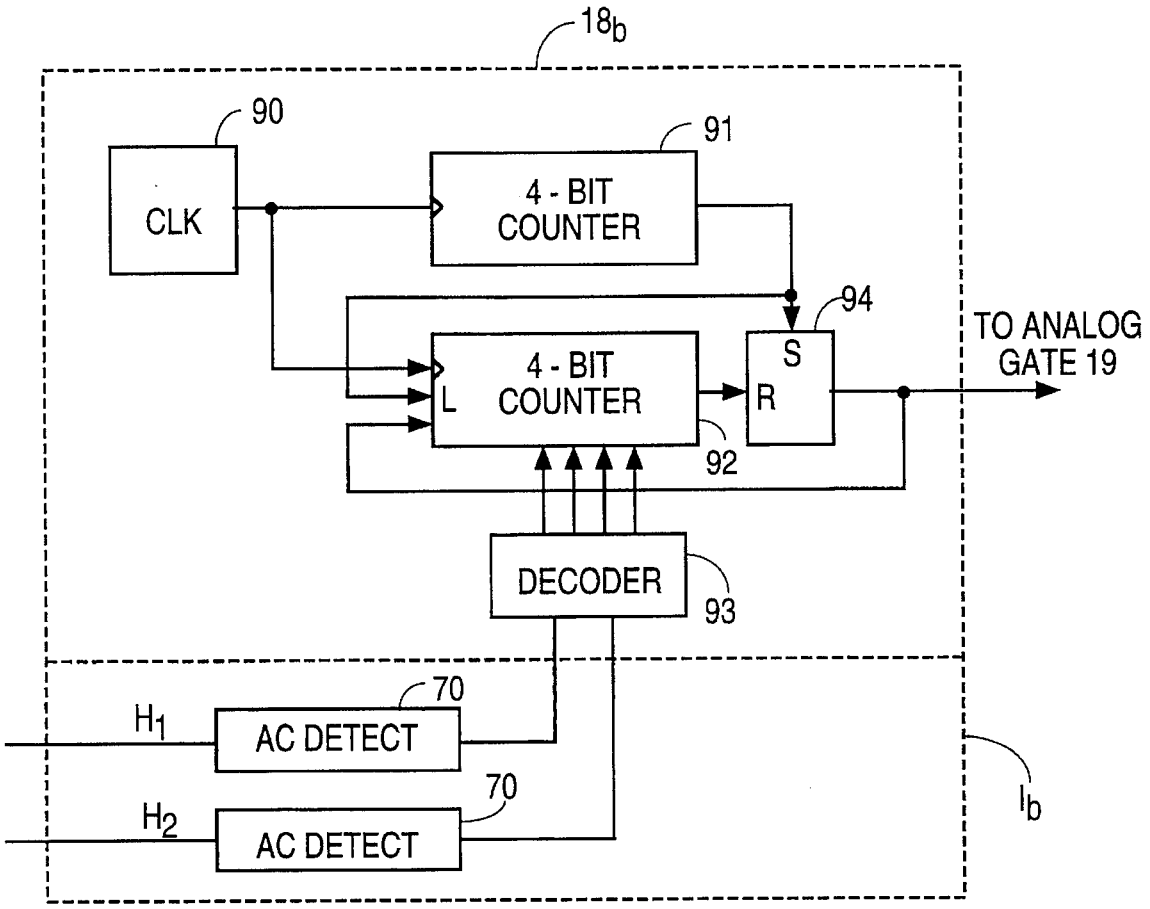
FIG. 9 illustrates a block diagram of a digital embodiment of the dimming control unit.

FIG. 9 illustrates a digital dimmer control unit $18_b$. A clock 90 operates at 1000 Hz, delivering clock pulses to a pair of 4-bit counters, a period counter 91 and a duty cycle counter 92. Since the clock pulses are separated by 1.0 millisecond, a full period of 4-bit counter 91 (16 states) is equivalent to 16 milliseconds. Each time counter 91 carries, it causes duty cycle counter 92 to be reloaded with a 4-bit word presented by a duty cycle decoder 93. This 4-bit word represents the number of counts until counter 92 carries, i.e., counter 92 is a down counter. Counter 92 is associated with an output latch 94. Output latch 94 is set when period counter 91 carries and is reset or cleared when duty cycle counter 92 carries. (Set must have precedence over clear.) The output of latch 94 is directed to analog gate 19 (FIG. 5). When latch 94 is set gate 19 is open; when latch 94 is cleared gate 19 is closed.

For example, if a binary 8 (1000) is loaded into counter 92 when counter 91 carries, latch 94 will remain set (output high) for eight down counts (8 milliseconds) until counter 92 carries. The latter event clears latch 94, and latch 94 remains low until counter 91 again carries. Delivered to analog gate 19, the output of latch 94 in this instance represents a duty cycle of about 50%. In this embodiment, since analog gate 19 is open when latch 94 is set, a lower binary number supplied by decoder 93 corresponds to a shorter duty cycle.

Figure 7:
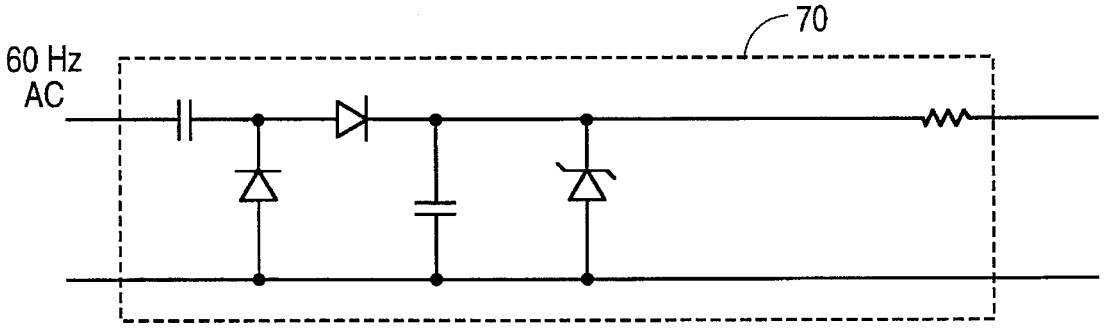
FIG. 7 illustrates a circuit diagram of an AC signal detector.

Dimmer control unit $18_b$ is controlled by an input control device/interface $I_b$. Input control device $I_a$ is designed to operate with a three-way fixture and thus it contains a pair of AC detectors 70, shown in detail in FIG. 7, which detect the presence of a 60 Hz signal on lines $H_1$ and $H_2$. Decoder 93 converts the status of lines $H_1$ and $H_2$ to a 4-bit word, which represents the desired duty cycle. For example, if a 60 Hz signal appears on both $H_1$ and $H_2$, decoder 93 delivers a binary 15 to counter 92, which corresponds to a 100% intensity level.

Referring again to FIG. 1, input control device/interface I may include an interface with a radio frequency or infrared communication channel or an interface which receives control signals transmitted over the power lines. An example of the latter is found in U.S. Pat. No. 5,090,024.

Figure 10:
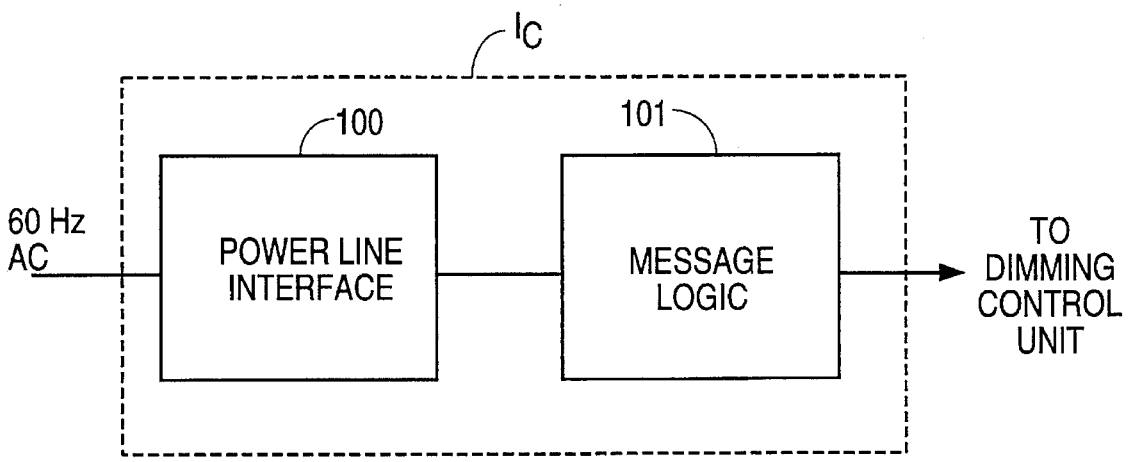
FIG. 10 illustrates a block diagram of an input control device/interface which includes an interface for receiving commands through the power lines.
Figure 11:
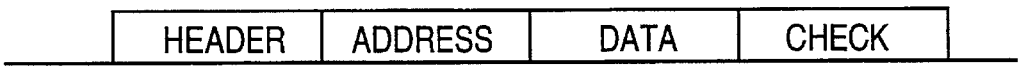
FIG. 11 illustrates a possible form of data packet for use with the interface of FIG. 10.

FIG. 10 illustrates an input control device/interface $I_c$ for controlling an electrodeless discharge lamp by information transmitted over the power lines. A power line interface 100 is an interface of the kind disclosed in U.S. Pat. No. 5,090,024, for example. Interface 100 recognizes the presence of control data on the power line. The data are delivered to a message logic unit 101 for evaluation. The data may be in the form illustrated in FIG. 11, consisting of a header, an address, the control data and a check. Each lamp contains a unique serial number or address which may, for example, be stored in a 48-bit Silicon Serial Number device (DS2400) manufactured by Dallas Semiconductor. The serial number or address may be programmed at the factory or by the user. Message logic unit 101 determines whether the header satisfies certain standards and then determines whether the address matches the identification number stored in the lamp. If both of these conditions are satisfied, and if the check validates, then the data are sent to dimming control unit 18.

Figure 12:
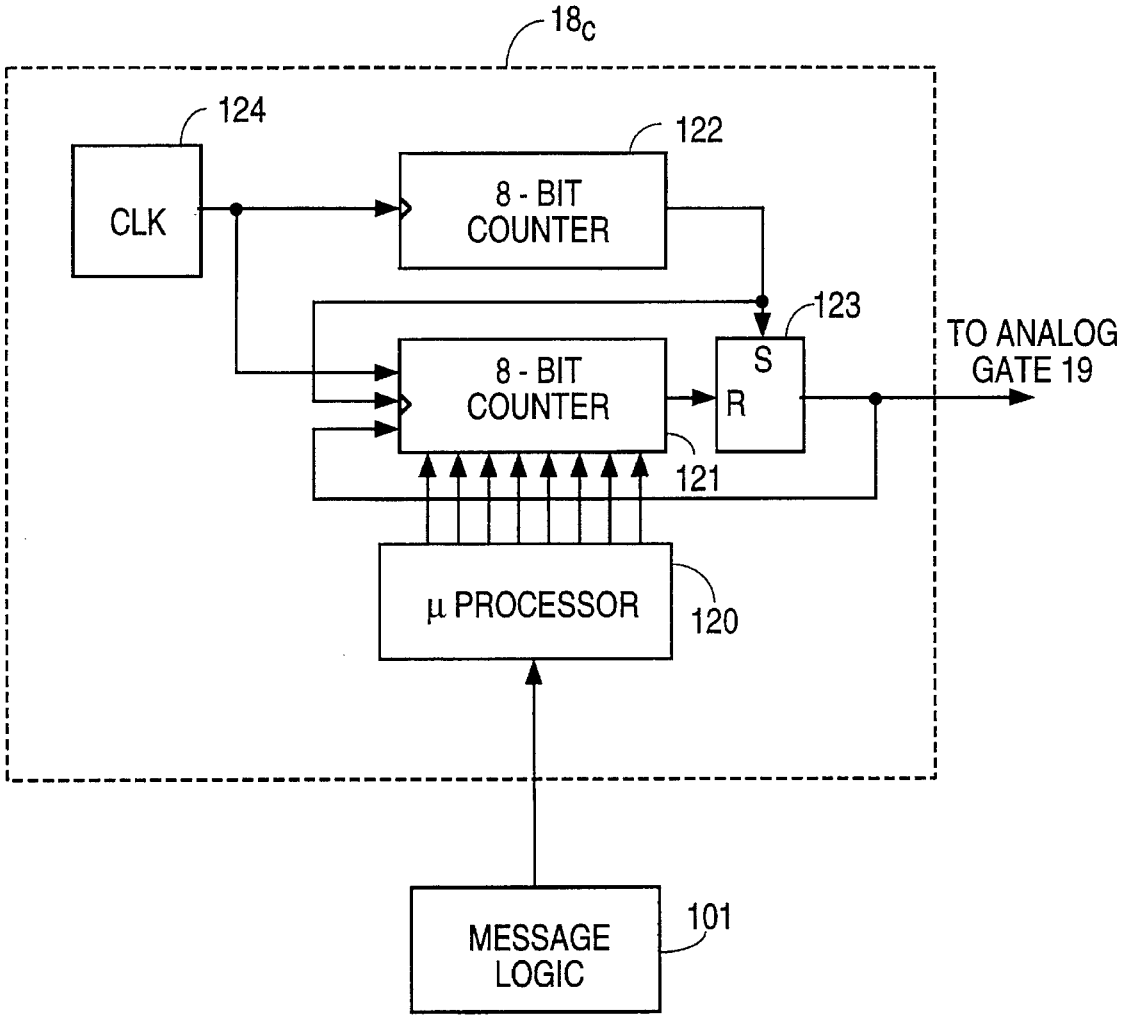
FIG. 12 illustrates a digital embodiment of a dimmer control unit which includes a microprocessor.

FIG. 12 illustrates a dimming control unit $18_c$, which includes a microprocessor 120. Microprocessor 120 is programmed to deliver an 8-bit word to an 8-bit period counter 121, representing the desired intensity of the lamp, in response to the data received from message logic unit 101. Period counter 121, an 8-bit duty cycle counter 122 and a latch 123 operate in a manner similar to counters 91 and 92 and latch 94 described above in connection with FIG. 9, to deliver a control signal to analog gate 19. However, since counters 121 and 122 are 8-bit counters (256 states), clock 124 operates at 16 kHz in order to provide a maximum duty cycle of 16 milliseconds.

Figure 13:
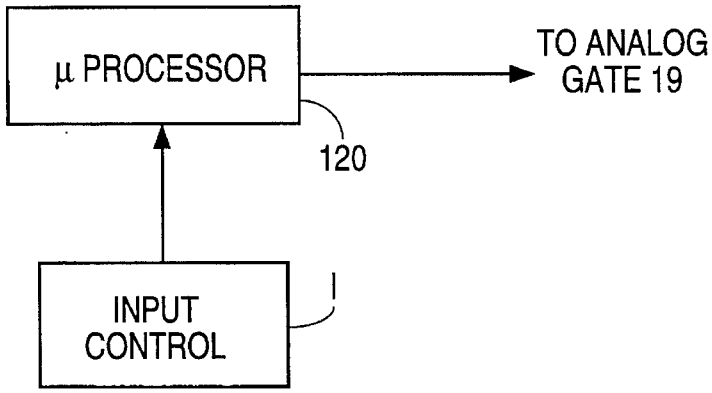
FIG. 13 illustrates an alternative embodiment including a microprocessor.
Figure 14A:
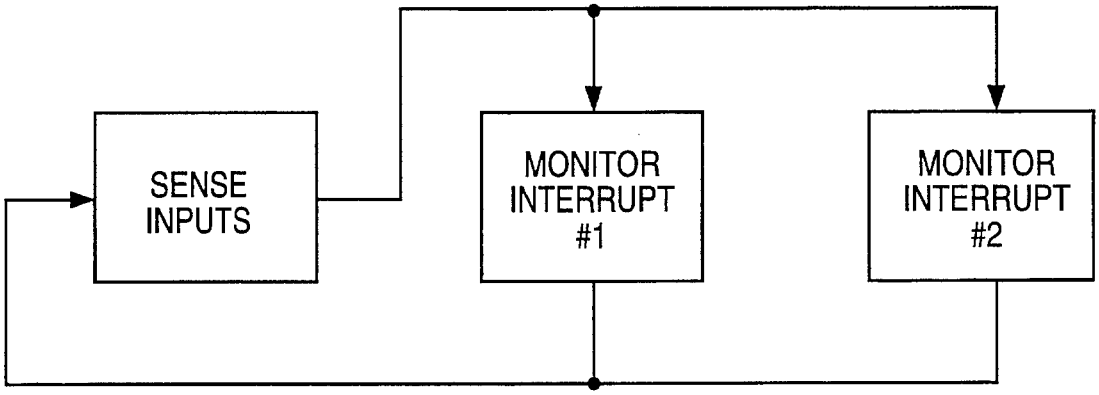
FIGS. 14A–14C illustrate a flow chart of the program run in the microprocessor of FIG. 13.
Figure 14B:
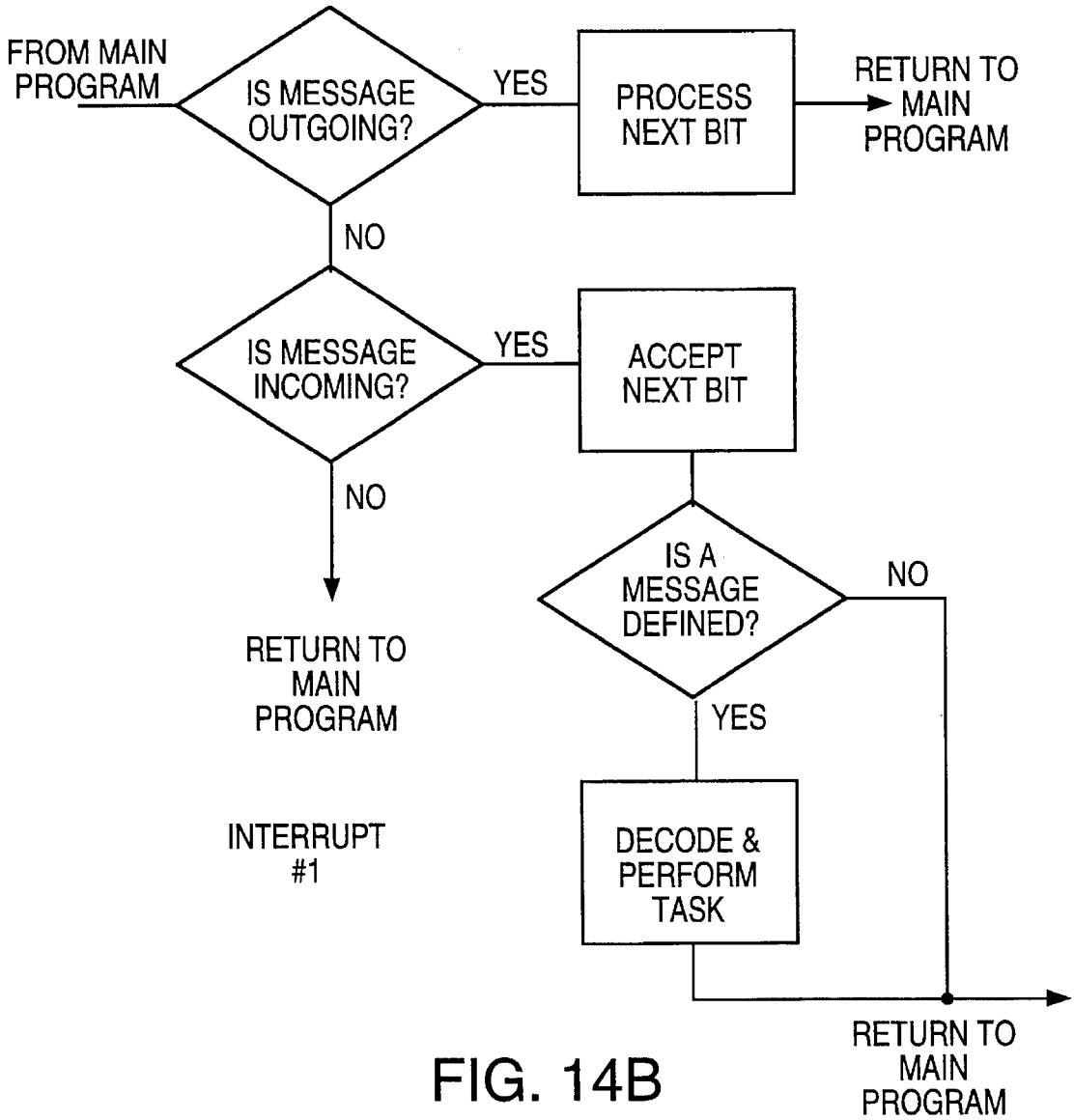
Figure 14C:
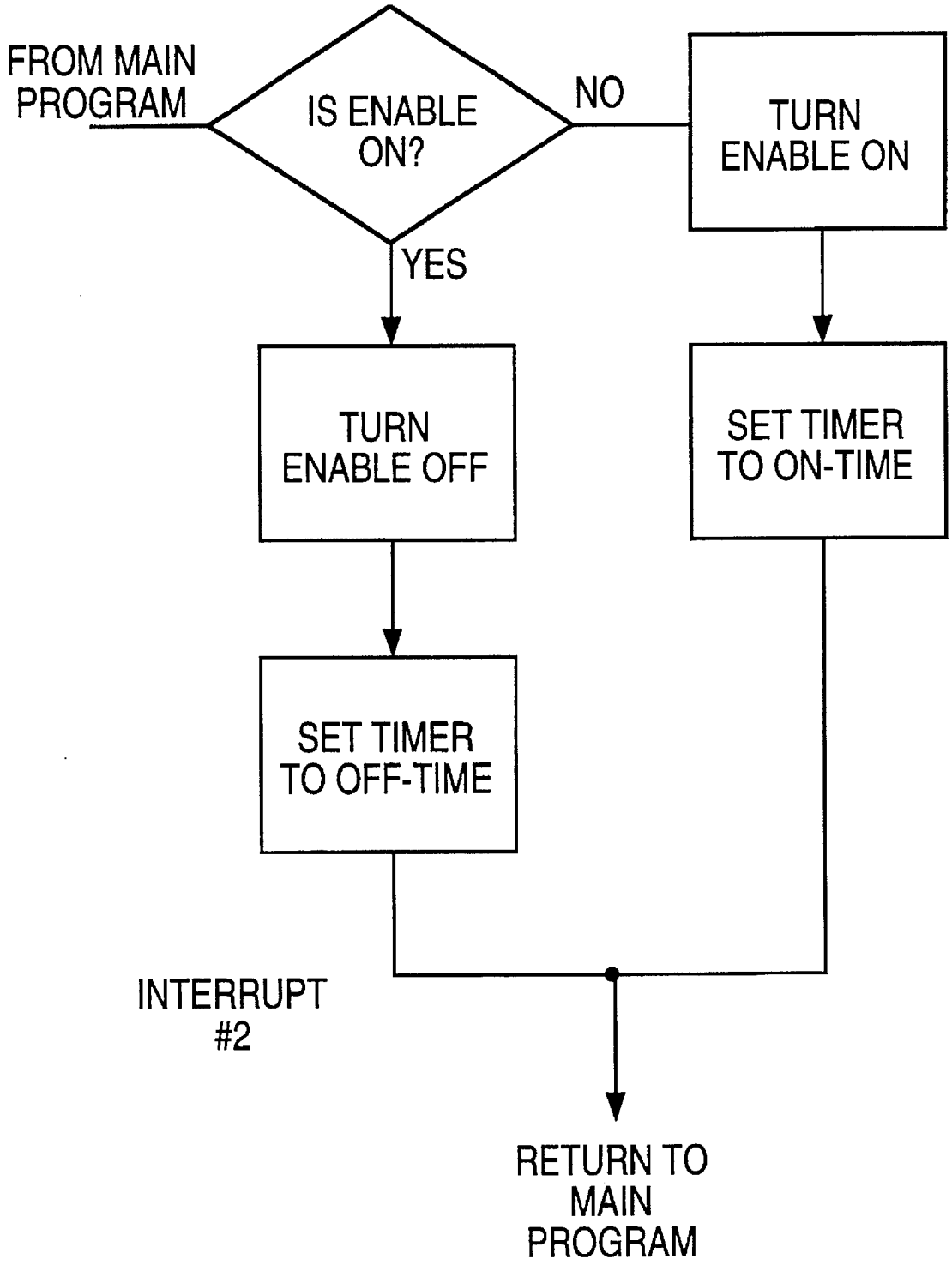

Alternatively, microprocessor 120 may be programmed so as to deliver a signal directly to analog gate 19, as shown in FIG. 13. FIGS. 14A–14C illustrate a flow chart for a program used to control microprocessor 120. The program consists essentially of a main program (FIG. 14A) and two interrupt programs (FIGS. 14B and 14C). Interrupt Program #1 handles the processing of incoming and outgoing messages and Interrupt Program #2 controls the condition of analog gate 19. Interrupt Program #1 is triggered whenever the communication hardware (e.g. a UART) indicates that it either has received a character or has just finished transmitting a character. Interrupt Program #2 is triggered when the timer which controls the analog gate is timed out, indicating that it needs to be toggled and reloaded with a new time value. The "Sense Inputs" step of the main program includes monitoring all switches and sensors associated with the lamp to determine the correct duty cycle and detect the need for an outgoing message to be sent. The final step of Interrupt Program #1 is "Decode and Perform Task". This could include a variety of tasks, such as increasing or reducing the intensity (ramping down or up) until a stop instruction is received, setting the intensity to a desired level (percentage of full output), including 0% and 100%, responding in a predetermined way an emergency indication (e.g., turn on to 100%).

Many additional embodiments are feasible with a microprocessor. As noted above, a microprocessor may be driven by data transmitted over the power lines, as in home automation systems using the standards of the CEBus system, BACNET, Echelon Lonworks, SmartHouse, etc. The CEBus system is described in "Interim-Standard No. 60", Vols. 1–8, Electronic Industries Association, Engineering Department (1991), and Echelon Lonworks is described in "Lonworks Products", Echelon Part No. 002-0009-01 (1992), both of which are incorporated herein by reference.

Figure 15:
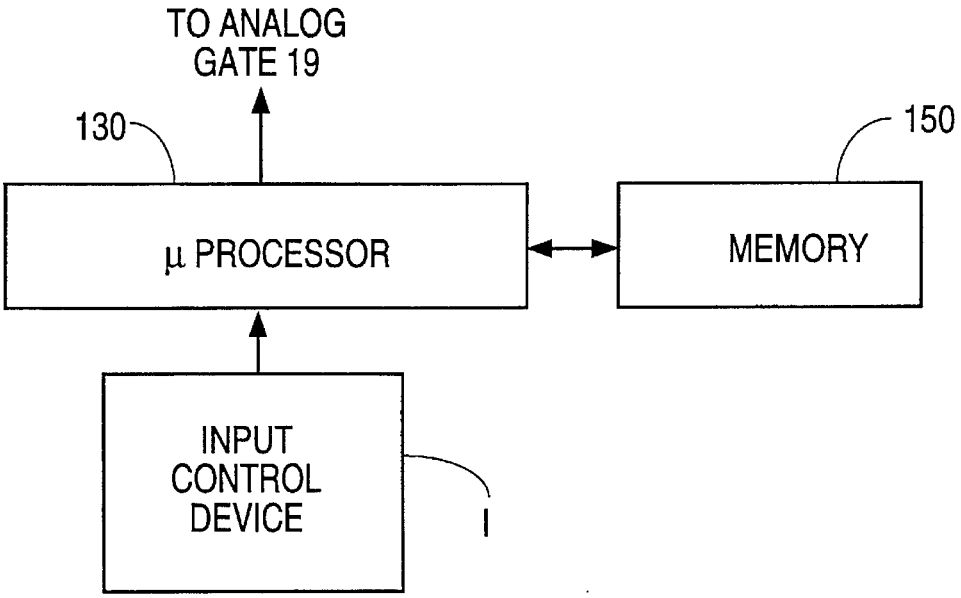
FIG. 15 illustrates a block diagram of an embodiment which includes a memory.
Figure 16:
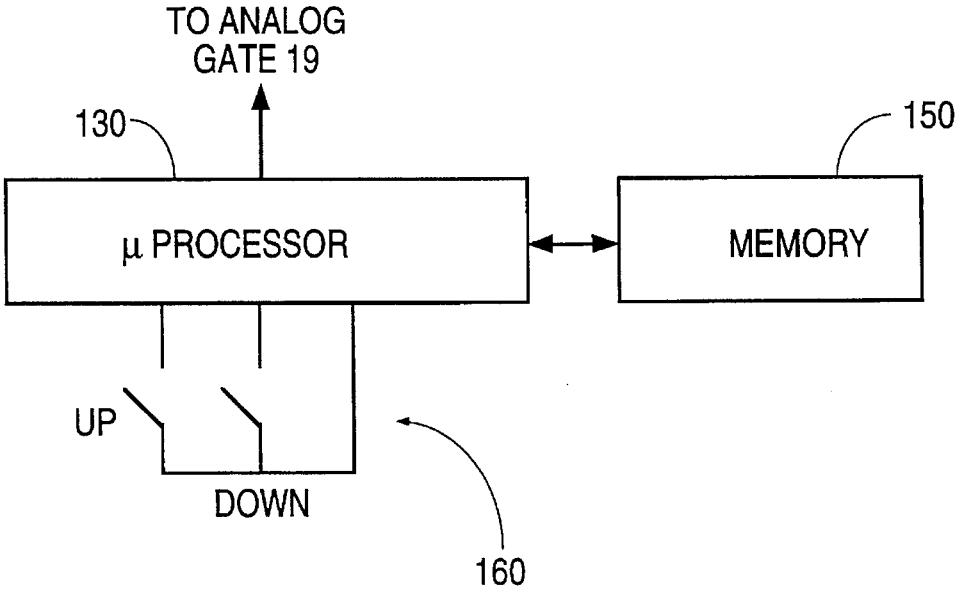
FIG. 16 illustrates a block diagram of an embodiment which includes a touch button control for adjusting the intensity of the lamp.

The data may also be transmitted over an infrared or radio frequency communication channel or over a separate "twisted wire" conduction path. Using AC detectors, the microprocessor could sense the states of the contacts of a three-way socket and control the duty cycle accordingly. As shown in FIG. 15, an EEPROM or nonvolatile memory 150 could be associated with a microprocessor to store the desired setting of the lamps for future use. As shown in FIG. 16, an up-down touch button 160, a rotary control knob or collar or other type of switch could be used to enter a desired intensity manually into the microprocessor, and this setting could likewise be stored. The microprocessor could be located inside the lamp or it could be positioned on a lamp fixture. Since in some applications the programming may be quite simple, another type of control device such as an ASIC (application specific integrated circuit) may be substituted for the microprocessor. Most of the "home automation" arrangements will require that each lamp have a unique stored serial number or address, as described above.

It will be understood that a number of the components shown in the drawings may be included in a single integrated chip.

Figure 17:
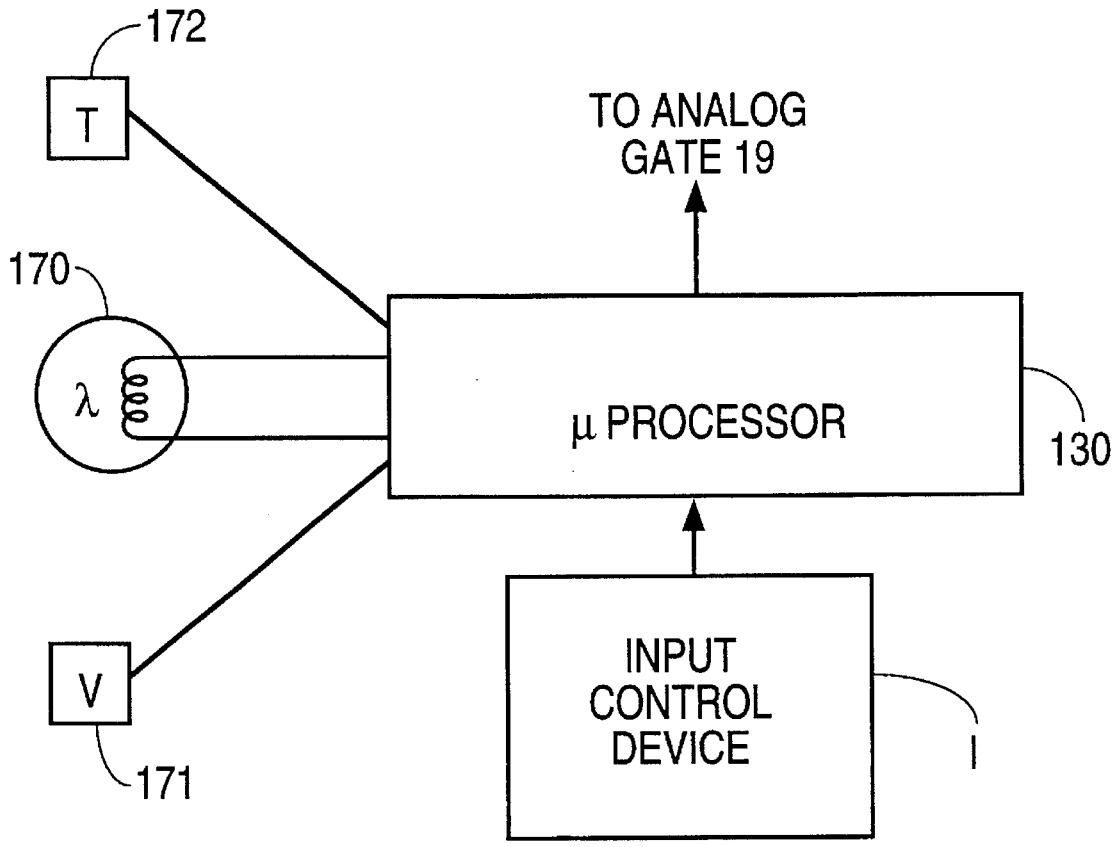
FIG. 17 illustrates a diagram of a lamp which includes a light level detector, a temperature detector and a voltage detector.

Another embodiment is illustrated in FIG. 17. A photocell 170 connected to microprocessor 130 monitors the ambient light in, for example, a room with outside windows. Microprocessor 130 adjusts the output to analog gate 19 to maintain the total amount of light in the room at a desired level. The microprocessor may readily be programmed to provide a response proportional to the error (i.e., the difference between the actual and desired light levels). Moreover, if the phosphors used in the lamp are capable of responding to rapid changes in the level of incident UV energy, the microprocessor could be programmed to sense the light reading at photocell 170 during periods when the lamp is off, and to adjust the duty cycle (on-time) of analog gate 19 so as to add a predetermined amount of light to the ambient conditions.

FIG. 17 also shows a voltage detector 171 and a temperature detector 172 associated with microprocessor 130. Both of these function as protective elements. Voltage detector 171 senses the voltage at an appropriate point (e.g., at the power line input or at the output of the power supply) and automatically turns the lamp off if it detects a voltage that is either too high or too low. Temperature detector 172 is mounted in the base of the lamp and normally turns the lamp off if the temperature detected is above a specified level.

Figure 18:
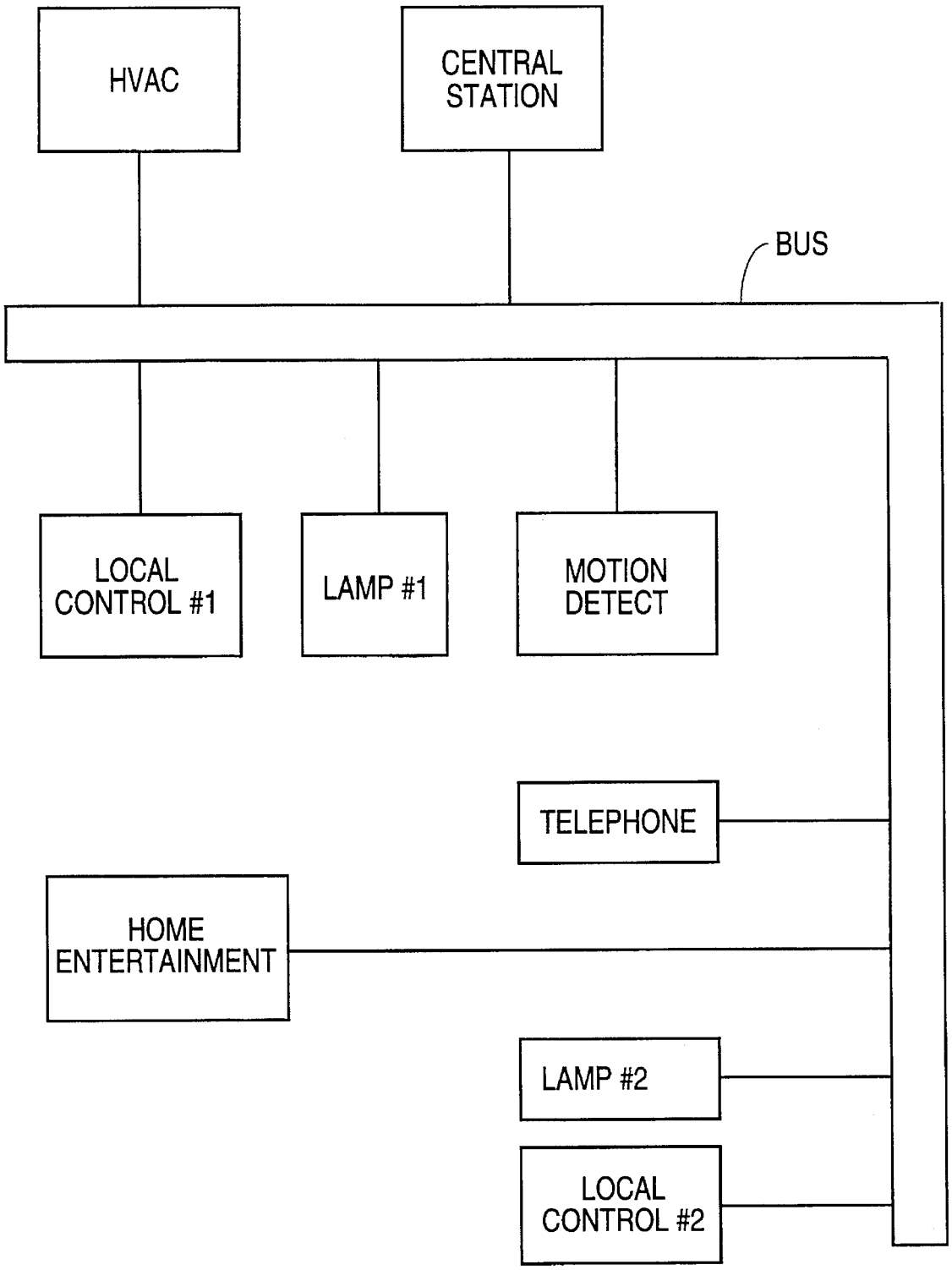
FIG. 18 illustrates a diagram of a network including a number of locally and centrally controlled lamps.

FIG. 18 illustrates a network showing how a number of electrodeless discharge lamps may be connected into a control network in a home or office. All of the elements shown have unique addresses and communicate with each other via a bus. A central station may issue dimming commands to Lamp #1 or Lamp #2, and Lamps #1 and #2 may also be controlled by Local Controls #1 and #2, respectively, which may be wall-mounted microprocessors, for example. The central station may issue timed commands, for example instructing Lamps #1 and #2 to turn on at 8:00 A.M., dim at 5:00 P.M., and turn off at 9:00 P.M. A motion detector located in the same room with Lamp #1 may issue a command to turn that lamp on whenever it senses the presence of people in the room.

Control of the lamps may be coordinated with other functions and instruments in the home or office. For example, the ringing of a telephone could be sensed, and the central station could respond by issuing an instruction to turn a light on in the room where the telephone is located. For hearing impaired persons, a lamp could be made to flicker when the telephone is ringing. When Local Control #1 is used to turn Lamp #1 off, this could be sensed by the central station and the HVAC (heating, ventilation, and air conditioning) system could be instructed to turn the heat down in that room.

It will be appreciated that the control possibilities created by the dimmer controls and "smart" lamp according to this invention are virtually limitless.

In the embodiments described above, the total period (maximum duty cycle) of the lamp was about 16 milliseconds. This period may be either lengthened or shortened. If it is lengthened, however, at some point the lamp will evidence a noticeable flicker (which may be desirable in some applications). If it is shortened, a different situation may occur. If an electrodeless discharge lamp is turned fully off, with the plasma dissipated, a time interval of about 0.5 milliseconds following the energization of the induction coil is encountered before the lamp reaches its H mode. As noted above, during this 0.5 millisecond period the lamp passes through the E mode. If the off-time is less than about 1.0 millisecond, however, the plasma does not completely subside each time the UV radiation is interrupted. In this situation, the lamp need not pass through the E mode each time it is turned on. Thus if the maximum off-time is greater than about 1.0 millisecond (allowing the plasma to die), the minimum on-time should be substantially greater than 0.5 millisecond to insure that the lamp is operating primarily in the H mode. On the other hand, if the maximum off-time is less than about 1.0 millisecond, there is no minimum on-time. However, the lamp should be on at least about 5% of the time, to insure that the plasma is adequately maintained.

For example, dimming control 18 of FIG. 1 could be clocked at 1600 Hz by including a 1600 Hz oscillator rather than using the 60 Hz line voltage. If this is done, the total period (maximum duty cycle) is about 625 microseconds, and the plasma does not need to be reignited each time the lamp is turned on. This frequency is close to the lower limit of frequencies which will keep the plasma alive, and it may be increased by several orders of magnitude.

Figure 19:
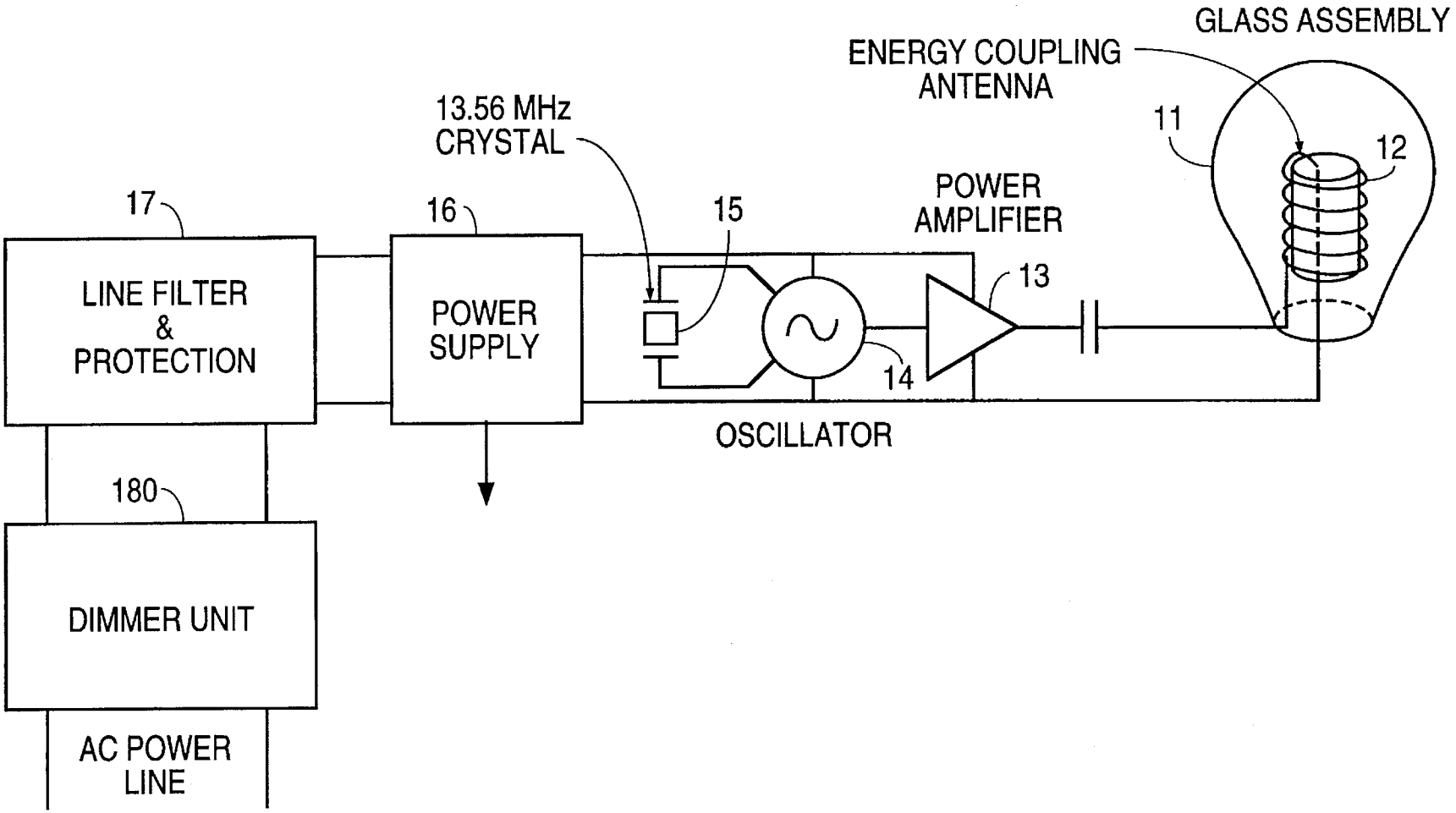
FIG. 19 illustrates a block diagram of a dimmer control unit for varying the voltage delivered to the power supply of the lamp.

The dimming control unit may also be positioned in the 60 Hz AC power line, as illustrated in FIG. 19. Dimmer unit 180 may include a commercially available dimmer such as a triac or a variac. Dimmer unit 180 limits the voltage input to power supply 16, and thereby reduces the amplitude of the output from amplifier 13 and the energy radiated from induction coil 12. If a triac is used, power supply 16 should not contain any switching elements that could be damaged during the off-times of the triac or, if switching elements are included, a large storage capacitor should be connected across the control circuitry to ensure continuous power to the control circuitry.

Figure 20:
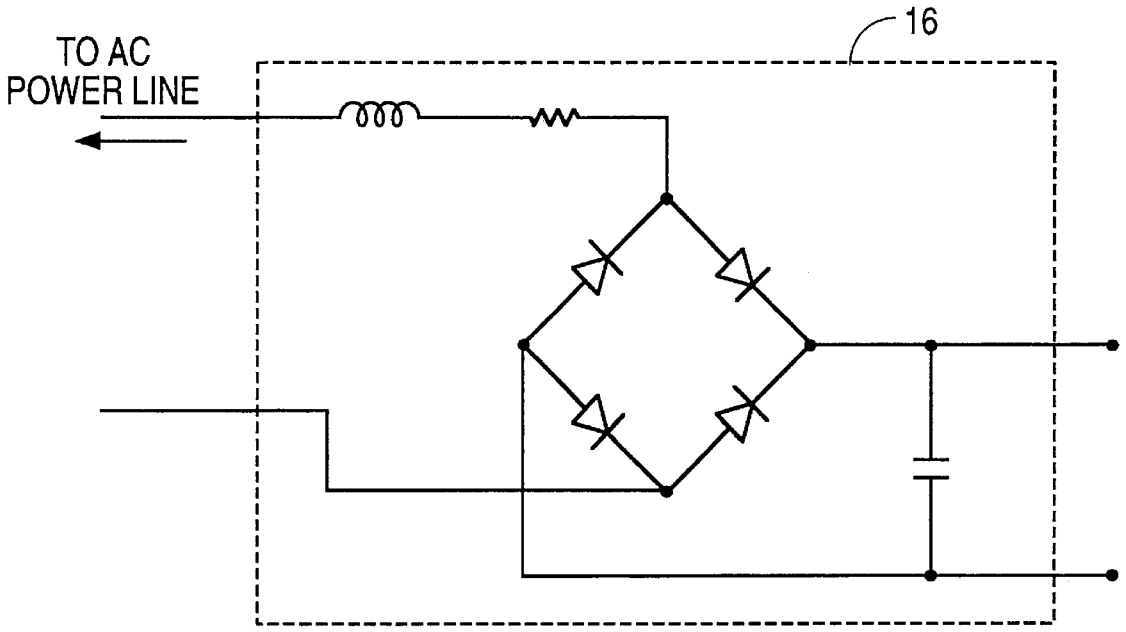
FIG. 20 illustrates a simplified circuit diagram of a power supply containing no switching components.

FIG. 20 illustrates in simplified form a circuit diagram of a non-switching component power supply which could be controlled by a triac.

Figure 22:
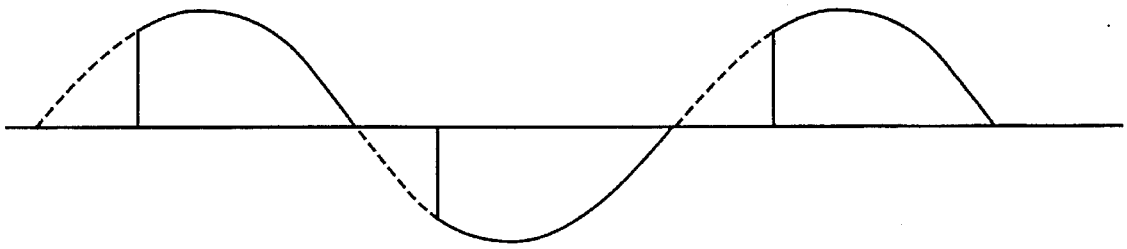
FIG. 22 illustrates the waveform delivered by the triac.
Figure 21:
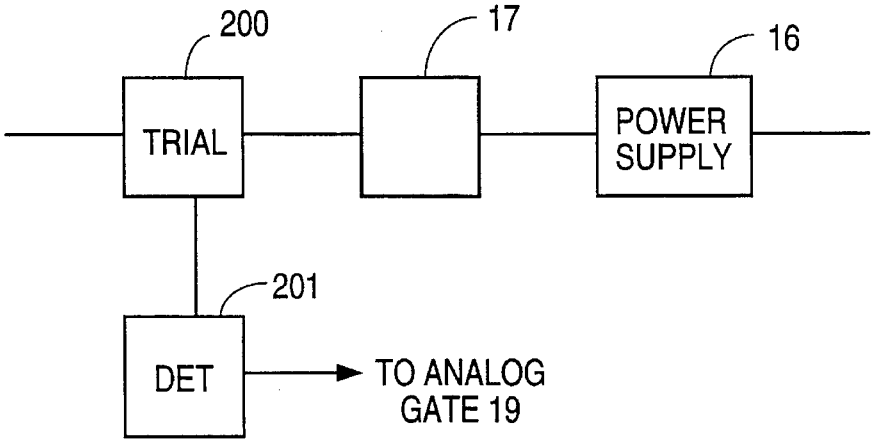
FIG. 21 illustrates a block diagram including a triac for adjusting the intensity of the lamp.

FIG. 21 shows an alternative embodiment using a triac 200. As shown in FIG. 22, the waveform from a triac is equivalent to a "chopped" sine wave, in which the voltage remains at zero during an adjustable delay period after each zero crossing. A detector 201 senses the vertical leading edge of each half-wave and transmits a signal which opens analog gate 19. When the waveform falls to 0 V, this is also detected and detector 201 transmits a signal closing analog gate 19. Thus, the lamp is effectively disabled whenever the output of triac 200 is chopped (i.e., equals 0 V), and there is no need to include large capacitors in the circuitry to store charge during these time intervals.

Figure 24:
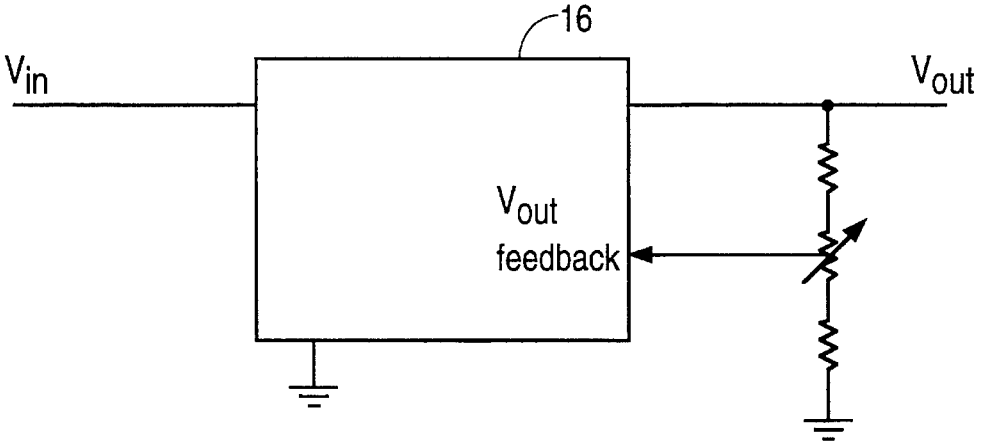
FIG. 24 illustrates a more detailed diagram of an output control circuit for a switching power supply.
Figure 23:
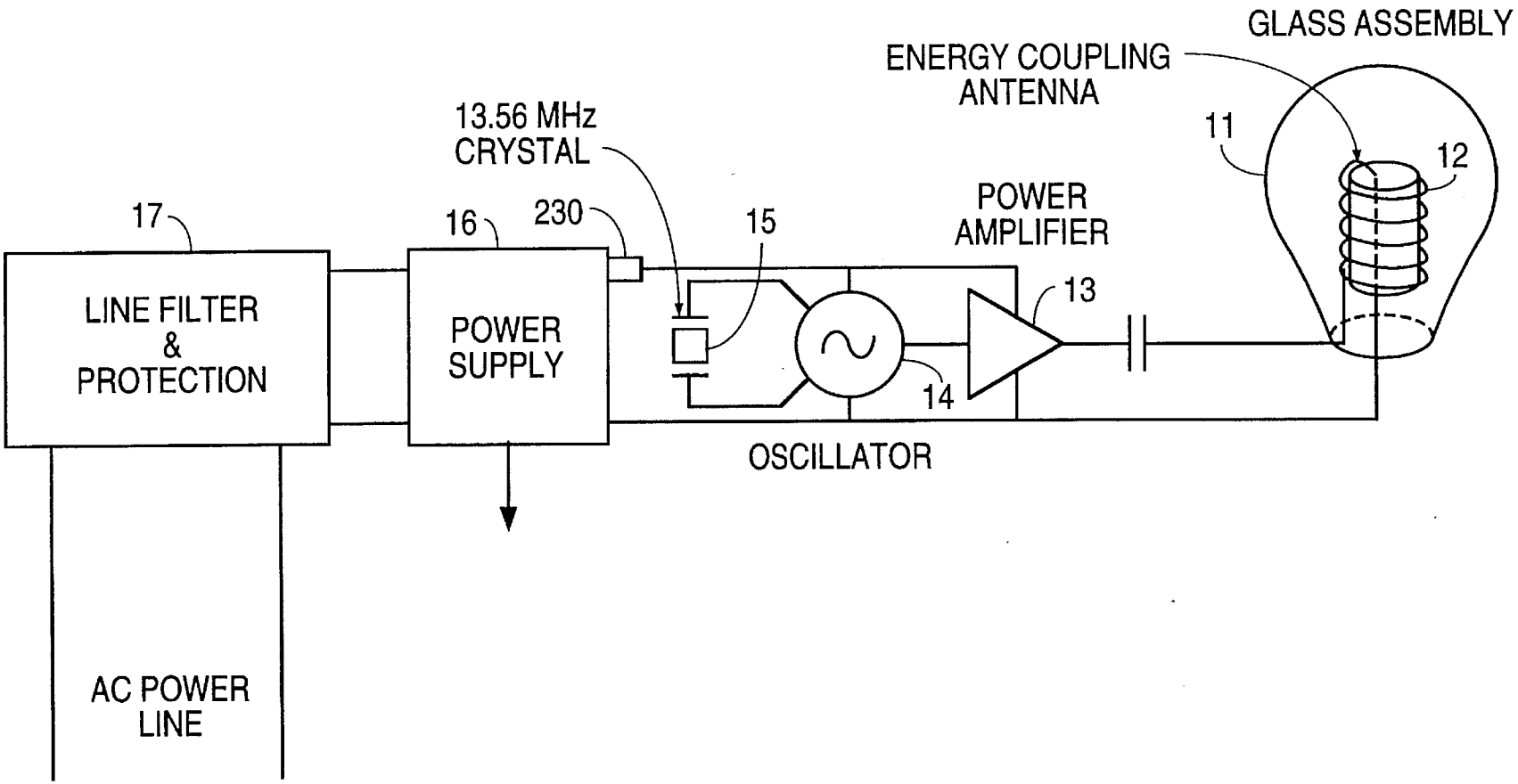
FIG. 23 illustrates a block diagram showing an output control for a switching power supply.

Alternatively, the output of a switching power supply may be controlled by connecting a potentiometer directly to the power supply, as illustrated in FIG. 23. A potentiometer 230 is connected in a feedback loop on the output side of the power supply, as illustrated in FIG. 24. A feedback pin is commonly provided on power supply chips, and the manner of making this connection is well known in the art.

The foregoing embodiments are intended to be illustrative and not limiting. Many additional embodiments in accordance with this invention will be apparent to those skilled in the art, all of which are intended to be within the scope of this invention, as defined in the following claims.

We claim:

1. An electrodeless discharge lamp comprising:

a power supply;

an induction coil for supplying electromagnetic radiation to a gaseous mixture enclosed within a vessel;

a driver for supplying an oscillating electrical signal to said induction coil so as to create a plasma of circulating charged particles within said vessel, said driver comprising a power supply and a power amplifier;

a gate for controlling the flow of an input signal to said power amplifier; and a dimming control unit for controlling the state of said gate, wherein said dimming control unit is operative to periodically open and close said gate at a selected periodic rate, said rate defining a time period between successive openings of said gate, said gate being open so as to allow said induction coil to receive said oscillating electrical signal during a selected duty cycle portion of said time period, said gate being closed so as to prevent said induction coil from receiving said oscillating electrical signal during a non-duty cycle portion of said time period.

2. The electrodeless discharge lamp of claim 1 wherein the duration of said non-duty cycle portion of said time period is set such that said plasma does not completely subside during said non-duty cycle portion.

3. The electrodeless discharge lamp of claim 1 wherein said dimming control unit comprises a sawtooth waveform generator, said generator being for delivering a sawtooth waveform to an input of a comparator.

4. The electrodeless discharge lamp of claim 1 wherein said dimming control unit comprises a period counter, a duty cycle counter and a decoder for holding a binary number representative of said duty cycle portion, a carry output of said period counter being connected to a load terminal of said duty cycle counter, said unit being structured such that said binary number is loaded into said duty cycle counter when said period counter carries.

5. The electrodeless discharge lamp of claim 1 wherein said dimming control unit comprises a microprocessor.

6. The electrodeless discharge lamp of claim 1 comprising in addition an input control device/interface for supplying an analog or digital control value to said dimming control unit.

7. The electrodeless discharge lamp of claim 6 wherein said input control device/interface comprises first and second terminals for connecting to first and second hot leads of a three-way lighting fixture, respectively, and a third terminal for connecting to the neutral lead of said three-way lighting fixture, a current of a first magnitude flowing in said first terminal when an AC voltage appears on said first hot lead, a current of a second magnitude flowing in said second terminal when an AC voltage appears on said second hot lead, and circuitry for adding said current of said first magnitude and said current of said second magnitude to form a current of a third magnitude when said AC voltages appear on both said first and second hot leads.

8. The electrodeless discharge lamp of claim 6 wherein said input control device/interface comprises a manually operated transducer located on said lamp, said transducer being capable of providing a signal for controlling said means for enabling and disabling said driving means.

9. The electrodeless discharge lamp of claim 6 wherein said input control device/interface comprises an interface for receiving data transmitted over a power line.

10. The electrodeless discharge lamp of claim 9 wherein said input control device/interface comprises a memory for storing data transmitted over a power line.

11. The electrodeless discharge lamp of claim 10 wherein said memory comprises an EEPROM.

12. The electrodeless discharge lamp of claim 6 wherein said input control device/interface comprises a means for detecting the level of light.

13. The electrodeless discharge lamp of claim 2 wherein the duration of said non-duty cycle portion is less than about 1.0 millisecond.

14. The electrodeless discharge lamp of claim 2 wherein duration of said duty cycle portion is equal to at least 5% of said time period.

15. The electrodeless discharge lamp of claim 7 wherein said second magnitude is twice said first magnitude.

16. The electrodeless discharge lamp of claim 4 wherein said dimming control unit further comprises a latch, said output of said period counter being connected to a set terminal of said latch, an output of said duty cycle counter being connected to a reset terminal of said latch.

17. The electrodeless discharge lamp of claim 16 wherein an output of said latch is connected to said gate.

18. The electrodeless discharge lamp of claim 4 further comprising first and second terminals for connecting to first and second hot leads of a three-way lighting fixture, respectively, said first and second terminals being connected to first and second AC detectors, respectively, said AC detectors being connected to input terminals of said decoder.

19. The electrodeless discharge lamp of claim 1 further comprising a triac connected in an AC power line leading to said power supply and a detector having an input connected to said triac and an output connected to said gate, said detector detecting a vertical leading edge of a chopped signal generated by said triac and in response to said leading edge generating a signal which opens said gate.

20. The electrodeless discharge lamp of claim 1 wherein said driver further comprises a crystal-controlled oscillator, an output terminal of said oscillator being connected to an input terminal of said power amplifier through said gate.

* * * * *